US006189432B1

(12) United States Patent
Colarelli et al.

(10) Patent No.: US 6,189,432 B1
(45) Date of Patent: Feb. 20, 2001

(54) AUTOMOTIVE LIFT HYDRAULIC FLUID CONTROL CIRCUIT

(75) Inventors: Nicholas Colarelli, Creve Coeur; Paul W. Roloff, O'Fallon; Michael A. Olsen, Lake St. Louis, all of MO (US)

(73) Assignee: Hunter Engineering Company, Bridgeton, MO (US)

( * ) Notice: Under 35 U.S.C. 154(b), the term of this patent shall be extended for 0 days.

(21) Appl. No.: 09/267,522

(22) Filed: Mar. 12, 1999

(51) Int. Cl.[7] ..... F15B 11/22
(52) U.S. Cl. ..... 91/171; 91/515
(58) Field of Search ..... 91/171, 515; 187/215, 187/275

(56) References Cited

U.S. PATENT DOCUMENTS 3,625,115 * 12/1971 Tani et al. ..... 91/515
4,706,458 * 11/1987 Corghi ..... 91/515
5,012,898 5/1991 Tsymberov .
5,024,141 * 6/1991 Kawada ..... 91/171
5,096,159 3/1992 Fletcher .
5,199,686 4/1993 Fletcher .

* cited by examiner

*Primary Examiner*—F. Daniel Lopez
(74) *Attorney, Agent, or Firm*—Polster, Lieder, Woodruff & Lucchesi, L.C.

(57) ABSTRACT

A hydraulic control circuit comprises a power unit, a central processing unit, at least one feedback sensor, a valve manifold, and two or more hydraulic lifting cylinders interconnected with miscellaneous hydraulic hoses and electrical wiring. Basic lifting is regulated by a flow divider unit configured to distribute a flow of pressurized hydraulic fluid pumped from a fluid reservoir through the valve manifold to each of the lifting cylinders during a lifting operation. To compensate for any imbalance between the lifting cylinders, the central processing unit monitors the movement of the lifting cylinders, and is configured to divert, through a three-way valve in the valve manifold, an additional portion of the pressurized fluid flow to a lagging lifting cylinder. During decent operations, the central processing unit extracts an additional portion of the fluid return flow through the three-way valve from a lagging lift cylinder, such that at all times during either lifting or decent operations, each lifting cylinder and a supported runway are disposed in a substantially parallel configuration.

20 Claims, 1 Drawing Sheet

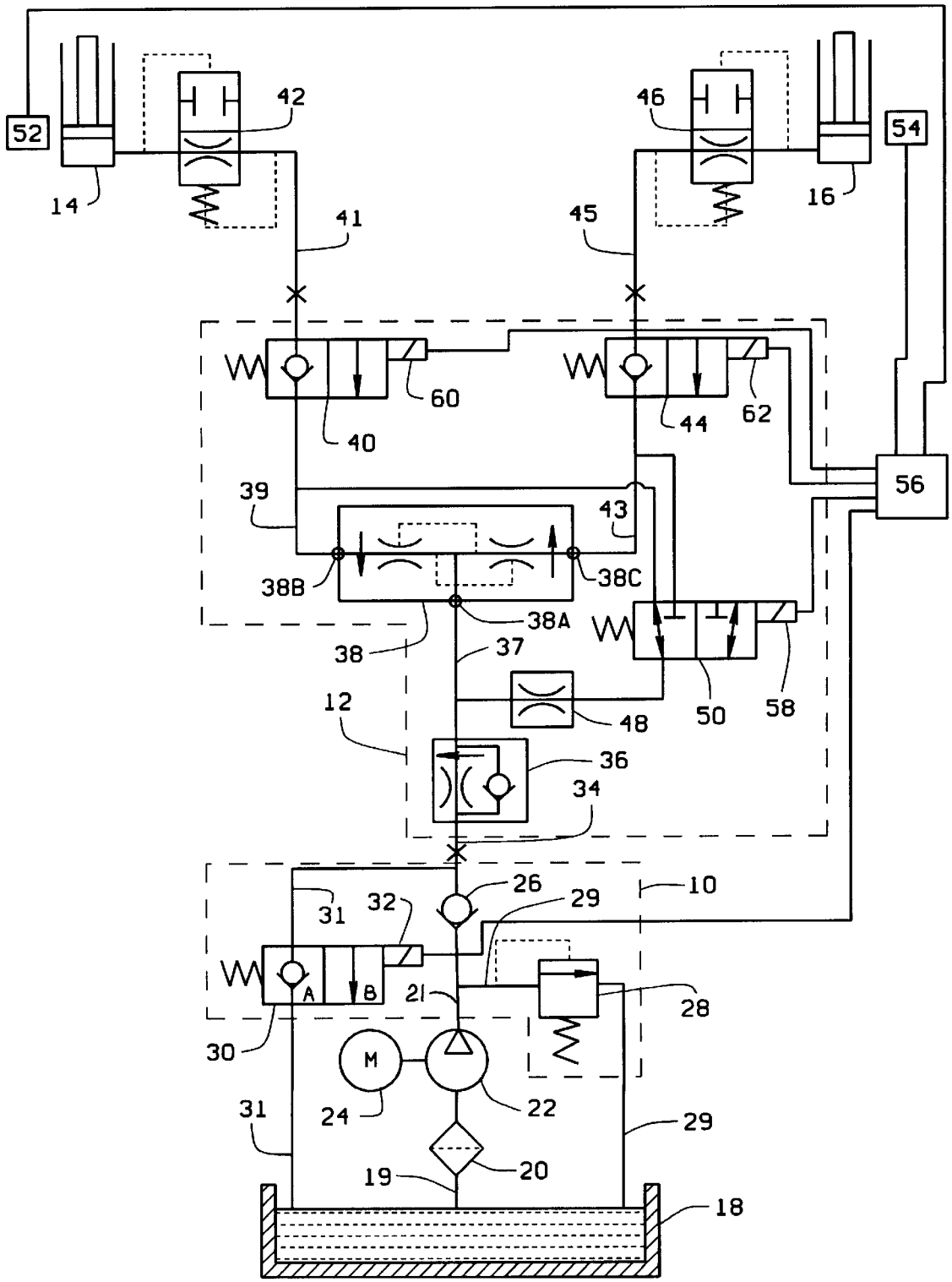
52
54
14
16
42
46
41
45
60
62
40
44
39
43
56
38B
38C
38A
38
37
50
58
48
12
36
34
26
10
31
32
29
A
B
21
28
30
M
24
22
31
29
19
20
18

AUTOMOTIVE LIFT HYDRAULIC FLUID CONTROL CIRCUIT

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

The present invention relates generally to a control for a hydraulic fluid distribution system utilized in an automotive vehicle lift rack having a pair of supporting runways each of which are elevated by at least one associated fluid actuated ram supplied from a common fluid reservoir, and more specifically, to a hydraulic fluid control circuit capable of compensating for uneven hydraulic fluid flow rates to and from the fluid actuated rams to maintain the runways in a level configuration under offset loading conditions at all times.

Traditionally, automotive repair shops and garages employ post-style hydraulic lifts having large hydraulic rams located below the floor of the garage to lift a pair of runways upon which a vehicle undergoing service is parked. These systems require excavations below the floor of the repair shop for the installation of the hydraulic ram or post, as well as for a hydraulic fluid reservoir and the associated plumbing. Due to increased regulations by the U.S. Environmental Protection Agency relating to the storage of potentially toxic fluids such as hydraulic fluid below ground, the trend in repair shops has been to utilize ground-level lift systems which do not require any below ground excavation or fluid storage.

Ground level lift systems, such as shown in U.S. Pat. No. 5,199,686 for "Non-Continuous Base Ground Level Automotive Lift System" and U.S. Pat. No. 5,096,159 for "Automotive Lift System", both to Fletcher are examples of parallelogram-style ground level automotive lifts. A comparable design is seen in U.S. Pat. No. 5,102,898 for "Control System for Vehicle Lift Racks" to Tsymberov. In the '686 and '898 systems, the pair of runways upon which the automotive vehicle undergoing service is parked are supported in an elevated position by separate hydraulic fluid rams or lifting elements. These rams are pressurized from a common hydraulic fluid circuit connected to an above-ground fluid reservoir. Several factors must be taken into consideration when designing and utilizing parallelogram lifts such as these. For example, there is a critical need to maintain each of the lift runways in a substantially parallel configuration at all times, despite the occurrence of uneven or offset loading conditions, as well as the need to maintain substantially the same fluid flow to each of the supporting hydraulic fluid rams during the raising or lowering of the lift runways.

As is shown in the '898 Tsymberov patent an even fluid distribution between the two or more hydraulic fluid rams can be achieved to some degree through the simple use of a flow divider/combiner valve, however, this is generally an inaccurate method of ensuring an even fluid distribution during offset loading conditions. The '686 Fletcher patent discloses the use of a complex arrangement of hydraulic control circuits and flow dividers utilized to coordinate the raising and lowering of the adjacent runways of a parallelogram lift, and to compensate for uneven flow rates of hydraulic fluid to each of the hydraulic rams. Specifically, the '686 patent employs a system control valve and a proportioning valve to control hydraulic fluid flow into and out of each supporting hydraulic fluid ram through both upper and lower ports. These circuits in the '686 patent utilize the arrangement of flow dividers and combination valves to either withdraw hydraulic fluid from a hydraulic cylinder which is elevating faster than another, or to withdraw additional hydraulic fluid from a hydraulic cylinder which is descending slower than another. In addition to incorporating a number of expensive components, these hydraulic fluid circuits often require lengthy calibration procedures to ensure that they are capable of maintaining a pair of runways in a substantially parallel configuration throughout the vertical operational range of the lift, even when loaded with an offset weight distribution.

Accordingly, there is a need to improve the design of the hydraulic fluid control circuits associated with these increasingly popular ground level lift systems and other lift systems having two or more independent lifting elements such that the circuits are inexpensive to manufacture, do not require extensive calibration and testing prior to operational installation, and are capable of maintaining the runways or lifting elements of the lift in a substantially parallel configuration throughout a vertical lift range despite severe offset loading conditions during the raising and lowering cycles.

BRIEF SUMMARY OF THE INVENTION

Among the several objects and advantages of the present invention are:

The provision of a hydraulic control circuit configured to regulate hydraulic fluid flow from a fluid reservoir to two or more hydraulic rams or cylinders configured to support the adjacent and independent runways of an automotive lift in a substantially parallel configuration during vertical elevation and lowering cycles;

The provision of the aforementioned hydraulic control circuit which is configured to regulate hydraulic fluid flow to and from the hydraulic rams or cylinders to maintain the lift runways in substantially parallel positions at all times during uneven or offset loading conditions;

The provision of the aforementioned hydraulic control circuit which is configured to regulate hydraulic fluid flow to and from the hydraulic rams to maintain the lift runways to within a predetermined and adjustable range of vertical variation from parallel at all times under an extreme offset loading condition;

The provision of the aforementioned hydraulic control circuit wherein the hydraulic fluid flow operation is controlled by a central processing unit;

The provision of the aforementioned hydraulic control circuit wherein the central processing unit is responsive to the vertical position of the pair of adjacent and independent lift elements to adjust hydraulic fluid flow to associated hydraulic rams;

The provision of the aforementioned hydraulic control circuit wherein the central processing unit is responsive to the angular positioning of a pair of laterally adjacent and independent lift element support legs to adjust hydraulic fluid flow to associated hydraulic rams;

The provision of the aforementioned hydraulic control circuit wherein the central processing unit is responsive to signals received from sensors secured to pivot points on laterally adjacent and independent lift element support legs to adjust hydraulic fluid flow to associated hydraulic rams;

The provision of the aforementioned hydraulic control circuit wherein the central processing unit operates a three-way, two-position valve to independently alter hydraulic fluid flow to the individual hydraulic rams;

The provision of the aforementioned hydraulic control circuit wherein an alternative embodiment the central processing unit operates a three-way, three-position valve to independently alter hydraulic fluid flow to the individual hydraulic rams;

The provision of the aforementioned hydraulic control circuit wherein fluid flow to a lagging hydraulic ram is increased during elevation of the automotive lift runways to maintain the pair of runways in a substantially parallel configuration during vertical movement;

The provision of the aforementioned hydraulic control circuit wherein fluid flow from a lagging hydraulic ram is increased during lowering of the automotive lift to maintain the pair of runways in a substantially parallel configuration during vertical movement;

The provision of the aforementioned hydraulic control circuit wherein the central processing unit is configured to include automatic operation of safety features;

The provision of the aforementioned hydraulic control circuit wherein the central processing unit is configured to cease movement of the automotive lift if the lift runways are detected to vary by more than a predetermined amount from a parallel configuration;

The provision of the aforementioned hydraulic control circuit wherein the central processing unit is configured to maintain the runway surfaces parallel to within a predetermined vertical variation under an offset loading condition;

The provision of the aforementioned hydraulic control circuit wherein it may be readily adapted for use in controlling the operation of any two or more independent hydraulically actuated components utilizing a common fluid source wherein there is a need to maintain a relative displacement between the actuated components; and The provision of the aforementioned hydraulic control circuit wherein a low cost, commonly available fluid flow divider component is utilized to provide a low cost, high accuracy fluid control circuit.

Briefly stated, the hydraulic control circuit of the present invention for use with a hydraulic lift system having two or more independent lifting elements. More specifically, a ground-level automotive lift system having two independent vehicle runways. The control circuit comprises a central processing unit, a power unit manifold, an auxiliary valve manifold, two or more hydraulic lifting cylinders, and at least one feedback sensor associated with the automotive lift system, all of which are interconnected with miscellaneous hydraulic hoses and electrical wiring to regulate the elevation or lowering of the automotive lift. Basic lifting or elevation is regulated by a flow divider/combiner valve unit configured to distribute a flow of pressurized hydraulic fluid pumped from a fluid reservoir through the auxiliary valve manifold to each of the hydraulic lifting cylinders or rams during a lifting operation. To compensate for any imbalance between the rate of extension of the lifting cylinders, the central processing unit monitors the movement of each of the lifting cylinders, and is configured to divert, through a valve in the auxiliary valve manifold, an additional portion of the pressurized hydraulic fluid flow to a lagging lifting cylinder to increase the rate of ascent. During decent or lowering operations, the central processing unit again compensates for any imbalances in the rate of retraction for each hydraulic cylinder by extracting an additional portion of the hydraulic fluid return flow from a lagging lift cylinder through the three-way valve, such that at all times during either lifting or decent operations, each hydraulic ram or cylinder and a supported runway lift are disposed in a substantially horizontal planar configuration. If the central processing unit detects a vertical displacement variation greater than a predetermined setting between the supported runways or lifting elements of the automotive life, the operations are halted until the discrepancy can be corrected.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification:

FIG. 1 is a schematic pressure fluid diagram showing the organization of the components in the hydraulic control system.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believe to be the best mode of carrying out the invention.

Turning to FIG. 1, a schematic pressure fluid diagram showing the organization of the components in the fluid control system of the present invention is illustrated. The fluid control system shown is the preferred embodiment, and comprises four main components, a power unit manifold 10, an bi-directional fluid flow divider/combiner circuit or auxiliary valve manifold 12, a left fluid ram or lifting cylinder 14, and a right fluid ram or lifting cylinder 16. The lifting cylinders 14, 16 are preferably secured to an automotive vehicle lift system (not shown) so as to vertically elevate two or more vehicle support runways or support members (not shown) to provide access to the underside of an automotive vehicle for service thereof. These components are interconnected with miscellaneous pipes and hoses in fluid communication to form a fluid circuit. In the preferred embodiment the system is utilized with a hydraulic fluid, although alternative fluids having the necessary compression and flow characteristics may be employed.

It will be readily recognized that additional pairs of hydraulic rams may be added to the control system of the present invention as required for the particular lifting application to which the system will be applied without deviating from the scope and concept of the invention. The power unit manifold 10 is located upstream from a hydraulic fluid reservoir 18. During operation, hydraulic fluid is drawn through an intake line 19 from the reservoir, through a filter 20, and pumped into the power unit manifold 10 along main line 21 by means of a pump 22 driven by an electric motor 24. The power unit manifold includes on the main line 21 a reverse flow check valve 26, a pressure relief valve 28 interconnected to the main line 21 downstream of the reverse flow check valve 26, and a two-way flow return valve 30 located upstream of the reverse flow check valve 26.

In a lifting cycle or pressurized operation of the control system, hydraulic fluid withdrawn from the reservoir 18 by suction generated at pump 22 passes through the reverse flow check valve 26 and into the auxiliary manifold 12. The reverse flow check valve 26 prevents the hydraulic fluid from returning to the pump 22 in the reverse direction. In the event pressure is detected in the hydraulic control circuit which exceeds a preset pressure relief setting, the pressure relief valve 28, located between the reverse flow check valve 26 and the motorized pump 22 will open, diverting a portion of the hydraulic fluid flow from the main line 21 back to the reservoir 18 along a return line 29, rather than allowing it to continue through the rest of the system.

During a lowering cycle of the control system, hydraulic fluid withdrawn from the left hydraulic lifting cylinder 14 and the right hydraulic lifting cylinder 16 returns to the fluid reservoir 18 after passing through the auxiliary manifold 12, through the two-way flow return valve 30 and return line 31. The returning fluid is prevented from returning to the reservoir 18 through the pump 22 by the reverse flow check valve 26 on the main line 21, and hence diverted to the two-way flow return valve 30. Normally in a reverse flow restricted position 30A, as shown in FIG. 1, the two-way flow return valve 30 is opened to a second position 30B by actuation of a solenoid 32 during a lowering cycle to permit the returning hydraulic fluid on return line 31 to flow unrestricted into the reservoir 18.

When the control system is actuated to provide lift to the left and right hydraulic lifting cylinders 14, 16 pressurized hydraulic fluid exiting from the power unit manifold 10 travels through a connecting hose 34 to the auxiliary manifold assembly 12. Upon entering the auxiliary manifold assembly 12, the fluid passes through a flow control valve 36 in the unmetered direction. The fluid exits the flow control valve 36 through line 37, and enters a fluid proportioning valve or flow divider/combiner valve 38 through port 38A where the fluid flow is split approximately equally to each port 38B and 38C. Fluid exiting the flow divider/combiner valve 38 through the port 38B enters branch line 39, and passes through a first two-way valve 40 in an unchecked direction, exiting the auxiliary manifold 12 and passing through a connecting hose 41 to a velocity fuse 42. The hydraulic fluid passes through the velocity fuse 42 in an unmetered direction to enter the left hydraulic lifting cylinder 14, exerting an expansion force thereon. Similarly, fluid exiting the flow divider/combiner valve 38 through the port 38C enters branch line 43 and passes through a second two-way valve 44 in an unchecked direction, exiting the auxiliary manifold 12 and passing through a connecting hose 45 to a velocity fuse 46. The hydraulic fluid passes through the velocity fuse 46 in an unmetered direction to enter the right hydraulic lifting cylinder 16, exerting an expansion force thereon.

Due to proportioning inaccuracy of the flow divider/combiner valve 38, the flow of hydraulic fluid under pressure through the valve 38 may not be split exactly in equal ratios to the ports 38B and 38C, thereby causing an unequal amount of hydraulic fluid to be diverted to either the left or right hydraulic lifting cylinder 14, 16. Such an uneven flow of hydraulic fluid causes one hydraulic lifting cylinder to expand at a rate different from the other, resulting in an uneven ascension of the automotive lift runways supported thereon. This condition may be further exaggerated if the automotive lift runways are not carrying an equal load.

To compensate for unequal flow distribution of hydraulic fluid during a lifting cycle, a small amount of hydraulic fluid is extracted from fluid line 37 in the auxiliary valve manifold 12 between the flow control valve 36 and the flow divider/combiner valve 38. The extracted hydraulic fluid is routed through a controlling orifice 48 and directed by a bi-directional fluid flow diverting valve, or three-way, two-position valve 50 to the branch line 39, 43 on the output side of the flow divider valve 38. Alternatively, valve 50 may be replaced with a three-way, three-position valve having a blocked flow position. The amount of fluid bypassing the flow divider valve 38 is controlled by the size of the opening in the control orifice 48, which may be altered to provide a desired fluid flow. The branch line 39, 43 to which the fluid is routed is selected for the hydraulic lifting cylinder 14, 16 which is observed to be lagging though feedback sensors 52 and 54. The feedback sensors 52, 54 are located on the lift structure (not shown) to which the hydraulic lifting cylinders 14, 16 are connected.

In the preferred embodiment, the feedback sensors 52 and 54 are Hall effects sensors which translate angular displacement from a rest position into a proportional voltage signal. Placing the sensors at pivot points in the lift structure (not shown) permits the sensors to observe the change in height of the lift structure by sensing the altered geometric relationships between elements of the lift structure. Those skilled in the art will readily recognize that a variety of sensors having sufficient sensitivity may be employed to observe variations in the geometry of the lift structure. For example, linear displacement sensors could be employed to directly measure the extension and retraction of the hydraulic lifting cylinders 14, 16. Signals from the feedback sensors 52, 54 are routed to an electronic control unit or central processing unit 56 which is configured, in the preferred embodiment, to digitally convert the voltage signals representing angular displacements at the sensors into changes in elevation of the runway lift structures as small as 0.125 inches. Alternative sensors with appropriate sensitivity may be utilized to detect a different amount of elevation variation, depending upon the particular application of the lift structure.

The central processing unit is further configured to detect whenever a vertical height variation of at least 0.25 inches in the preferred embodiment occurs between the vertical positions of the runway lift structures to which the hydraulic lifting cylinders 14, 16 are connected. The degree of detected variation may be adjusted at the central processing unit to allow for either coarser or finer adjustments to be made. Upon detecting a selected variation condition, the central processing unit actuates a solenoid 58 to divert a controlled portion of the fluid flow through the three-way valve 50 to the branch line 39, 43 connected to the lagging hydraulic lifting cylinder. Once the lagging hydraulic lifting cylinder 14, 16 receiving the diverted fluid flow extends sufficiently far to become the leading ram as detected by the feedback sensors 52, 54, the three-way valve 50 is switched by the central processing unit 56 to redirect the flow of extracted hydraulic fluid to the second hydraulic lifting cylinder 14, 16 which is now the lagging lifting cylinder. This process continues throughout the entire lifting cycle of the hydraulic control circuit.

In the unlikely event the central processing unit 56 detects a condition wherein the feedback sensors 52, 54 register a vertical position variance between the left and right hydraulic lifting cylinders 14, 16 exceeding a predetermined setting, a safety protocol will shut down operation of the hydraulic circuit until the condition is corrected. Such conditions could be caused by a ruptured hydraulic line or a blockage in the fluid circuit, with continued operations leading to a general failure of the system.

When the control system is actuated to lower the left and right hydraulic lifting cylinders 14, 16, the flow of hydraulic fluid through the system is substantially reversed. To permit hydraulic fluid to exit the hydraulic lifting cylinders 14, 16, the central processing unit 56 actuates solenoids 32, 60, and 62 simultaneously to shift each of the two-way valves 30, 40, and 44 from the checked flow positions to the free flow return positions. The force of gravity acting on the mass of the runway lift structures (not shown) supported by the hydraulic lifting cylinders 14, 16 will cause hydraulic fluid to exit the lifting cylinders 14, 16 through velocity fuses 42, 46. The velocity fuses 42, 46 meter the rate of fluid flow exiting the hydraulic lifting cylinders 14, 16. If the flow rate exceeds a predetermined amount, due to a ruptured hose for example, the velocity fuses 42, 46 will completely shut off all fluid exiting the hydraulic lifting cylinders 14, 16, locking the runway lift structure (not shown) in a safe condition.

Once the return flow of hydraulic fluid passes through the velocity fuses 42, 46, and the two-way valves 40, 44 in their free flow positions, it re-enter the flow divider/combiner valve 38 through ports 38B and 38C. Inside the flow divider/combiner valve 38, the two hydraulic fluid flows from the left and right hydraulic lifting cylinders 14, 16 are recombined into a single fluid flow in approximately equal ratios. The combined hydraulic fluid flow then exits the flow divider valve 38 through port 38A into line 37, and passes through the flow control valve 36 in the metered direction towards the power unit manifold 10. The flow control valve 36 is pressure compensated to regulate the speed at which the hydraulic fluid flows, thereby limiting the rate of descent for the hydraulic lifting cylinders 14, 16 regardless of the load carried thereby. Once through the flow control valve 36, the hydraulic fluid enters the power unit manifold 10, and is diverted by the reverse flow check valve 26 along return line 31 to the two-way valve 30, now in the free flow position, returning to the fluid reservoir 18.

As with expansion of the hydraulic lifting cylinders 14, 16, the inaccurate nature of the flow divider/combiner valve 38 prevents the two separate hydraulic fluids streams exiting from each of the hydraulic lifting cylinders 14, 16 from combining in exactly equal proportions as the fluid returns to the fluid reservoir 18. This unequal combination of the hydraulic fluid streams in the flow divider/combiner valve 38 causes one of the hydraulic lifting cylinders 14, 16 to lag behind the other during the descent cycle, exhibiting a vertical variance between the supported runway lift structures (not shown). This variance is detected at the central processing unit 56 from signals received through the feedback sensors 52, 54.

To compensate for the unequal combination of the hydraulic fluid streams at the flow divider/combiner valve 38, resulting in uneven descent rates for the automotive lift members, the central processing unit switches the three-way valve 50 to allow a portion of fluid from the lagging hydraulic lifting cylinder 14, 16 to bypass the flow divider valve 38 and return to the fluid reservoir 18 through the control orifice 48. The amount of fluid bypassing the flow divider valve 38 is controlled by the size of the opening in the control orifice 48, which may be altered to provide a desired fluid flow. Once sufficient hydraulic fluid has been withdrawn from the lagging hydraulic lifting cylinder 14, 16 such that it is now in a leading position, the central processing unit signals the solenoid 58 to switch the three-way valve to the second position, draining fluid from the second, now lagging, hydraulic lifting cylinder 14, 16. This process repeats until the descent cycle is completed. As in the ascent cycle, the central processing unit 56 is preferably configured to actuate the solenoid 58 upon detecting a vertical variance of only 0.25 inches between the runway lift surfaces secured to the hydraulic lifting cylinders 14, 16, however, the amount of vertical variance allowed may be adjusted to suit the application. Additionally, should the central processing unit 56 detect a predetermined vertical variance between the lifting elements any time during a descent cycle, the process will be halted as a safety measure.

In addition to running the pump 22 and regulating the bypass hydraulic fluid flows in response to readings obtained from the feedback sensors 52, 54, the central processing unit 56 is configured to perform a variety of functions, including calibration of the feedback sensors 52, 54 upon start-up, and regulation of the runway lift structure (not shown) minimum and maximum positions. For example, if the lift structure (not shown) were to comprise a pair of runway ramps for use in servicing an automotive vehicle, a maximum lift height for the lift structure could be set in the central processing unit 56 such that a vehicle placed on the runway ramps would not contact the ceiling or other overhead structures when elevated for servicing. Once the central processing unit detects that the hydraulic lifting cylinders 14, 16 have extended such that the lift structure (not shown) has reached the predetermined maximum lift height, the central processing unit 56 signals the motor 24 and solenoid 58 to stop operation. Additionally, upon detecting a certain minimum elevation, the central processing unit 56 could activate a number of auxiliary lights (not shown) secured to the lift structure (not shown).

The present invention additionally provides a method for regulating the ascent and descent of an above ground automotive vehicle lift system, particularly of the type having two independently articulated vehicle support members or runways actuated by a fluid pressure system. To raise the vehicle support runways, a fluid under pressure is supplied from a common fluid source to the fluid driven lifting components through a fluid circuit. Within the fluid circuit, the fluid flow is divided into substantially equal portions between each of the fluid driven lifting components. Due to the inaccurate nature of fluid proportioning circuits, and any offset loading between the vehicle support runways, one of the lifting components is likely to elevate an associated vehicle support runway at a rate greater than the other, resulting in a variation in vertical displacement. By observing any variations in vertical displacement exceeding a predetermined amount through sensors, additional fluid may be directed from the common fluid source to the lifting components which are observed to be lagging during the ascending motion.

During descending motion, or the lowering of the vehicle support runways, variations in the vertical displacement between the vehicle support runways is again observed through the sensors. By sensing any variations in vertical displacement exceeding a predetermined amount, additional fluid may be routed to the common fluid source from the lifting components which are observed to be lagging during the descending motion.

In view of the above, it will be seen that the several objects of the invention are achieved and other advantageous results are obtained. Those skilled in the art of hydraulic circuit design will readily recognize that a variety of valves other than those described in the preferred embodiment may be employed without changing the scope of the invention. For example, valves may utilize one solenoid and a compression spring to provide actuating movement, or may utilize two solenoids in a push-pull configuration. Similarly, it will be readily recognized that common substituting components are available which will function equally well. For example, the control orifice 48 may be replaced by an adjustable needle valve or a flow limiter without changing the scope of the invention. As various changes could be made in the above constructions without departing from the scope of the invention, it is intended that all matter contained in the above description or shown in the accompanying drawings shall be interpreted as illustrative and not in a limiting sense.

What is claimed is:

1. A hydraulic fluid control system for an automotive vehicle lift structure comprising:

a source of hydraulic fluid;

two or more hydraulically actuated lifting components in fluid communication with said source of hydraulic fluid, said lifting components extending or retracting in a linear direction responsive to a flow of said hydraulic fluid to raise or lower said automotive vehicle lift structure;

a fluid flow divider valve having three ports interposed between said source of hydraulic fluid and said two or more hydraulically actuated lifting components, said first port in fluid communication with said source of hydraulic fluid, said second port in fluid communication with at least one of said lifting components, and said third port in fluid communication with at least one other of said lifting components, said flow divider valve configured to reversibly divide a fluid flow entering said first port into substantially equal portions exiting through said second and third ports;

a bi-directional fluid flow diverting valve interposed between said source of hydraulic fluid and said two or more hydraulically actuated lifting components, said fluid flow diverting valve configured to establish a fluid flow connection between a selected one of said lifting components and said source of hydraulic fluid, bypassing said fluid flow divider valve;

an electronic control unit responsive to said vertical elevation of said vehicle lift structure to select a lifting component and to control said bi-directional fluid flow diverting valve to establish a fluid connected between said source of hydraulic fluid and said selected lifting component.

2. The hydraulic fluid control system of claim 1 further comprising:

a fluid velocity fuse interposed between each of said hydraulically actuated lifting components and said fluid flow divider valve, said velocity fuse configured to permit unrestricted fluid flow into said lifting component, and to regulate said fluid flow exiting said lifting component to block said exiting fluid flow if a predetermined flow rate is exceeded; and a two-way valve interposed between each of said fluid velocity fuses and said fluid flow divider valve, each of said two-way valves having a first position permitting fluid flow towards said lifting component only, and a second position having unrestricted fluid flow, said first and second positions selected by actuation of a solenoid.

3. The hydraulic fluid control system of claim 2 wherein said electronic control system is further configured to actuate said solenoid on each of said two-way valves, wherein fluid flow to and from said lifting components is controlled.

4. The hydraulic fluid control system of claim 2 wherein said bi-directional fluid flow diverting valve is configured to establish a fluid connection from said source of hydraulic fluid to a point between said two-way valve associated with said selected one of said lifting components and said fluid flow divider valve.

5. The hydraulic fluid control system of claim 1 further comprising a flow control valve interposed between said fluid flow divider valve and said source of hydraulic fluid, said flow control valve configured to permit unrestricted fluid flow into a fluid circuit connected to said first port of said fluid flow divider valve, and to regulate the flow of fluid returning to said source of hydraulic fluid.

6. The hydraulic fluid control system of claim 5 wherein said bi-directional fluid flow diverting valve is configured to establish a fluid flow connection between a selected one of said lifting components and said fluid circuit connected between said first port of said fluid flow divider valve and said flow control valve.

7. The hydraulic fluid control system of claim 6 wherein a control orifice is interposed between said bi-directional fluid flow diverting valve and said fluid circuit, said control orifice regulating fluid flow to and from said bi-directional fluid flow diverting valve.

8. The hydraulic fluid control system of claim 1 wherein said electronic control unit is a computer configured with software to select one of said lifting components and to control said bi-directional fluid flow diverting valve.

9. The hydraulic fluid control system of claim 1 wherein said electronic control unit is responsive to signals received from a plurality of sensors to select a lifting component and to control said bi-directional fluid flow diverting valve.

10. The hydraulic fluid control system of claim 9 wherein said plurality of sensors are Hall effect sensors, each of said sensors configured to detect angular displacement of a component of said automotive vehicle lift structure, said electronic control unit configured to relate said detected angular displacement to a vertical position of said automotive vehicle lift structure.

11. The hydraulic fluid control system of claim 9 wherein said plurality of sensors are linear displacement sensors, each of said sensors configured to detect linear displacement of a lifting component, said electronic control unit configured to relate said detected linear displacement to a vertical position of said automotive vehicle lift structure.

12. The hydraulic fluid control system of claim 9 wherein said electronic control unit is configured to control said bi-directional fluid flow diverting valve to establish a fluid flow connection bypassing said fluid flow divider valve to a lagging lifting component during raising or lowering of said automotive vehicle lift structure, as detected by said plurality of sensors.

13. The hydraulic fluid control system of claim 1 wherein said electronic control unit is further configured to prevent movement of said automotive vehicle lift structure responsive to predetermined elevation deviations between components of said automotive vehicle lift structure.

14. The hydraulic fluid control system of claim 1 wherein said source of hydraulic fluid comprises:

a pump and a fluid reservoir;

a fluid circuit to accommodate the flow of fluid under pressure by said pump from said fluid reservoir to said first port of said fluid flow divider valve;

a pressure relief valve in fluid communication with said fluid circuit, said pressure relief valve responsive to a predetermined pressure to return said flow of fluid under pressure to said fluid reservoir;

a reverse-flow check valve in said fluid circuit upstream from said pressure relief valve, said reverse-flow check valve configured to prevent a return flow of fluid to said pump; and a two-way flow return diverting valve in fluid communication with said fluid circuit upstream of said reverse-flow check valve, said two-way flow return valve configured to return a flow of said fluid to said fluid reservoir when opened.

15. The hydraulic fluid control system of claim 14 wherein said electronic control system is further configured to actuate said pump and said two-way flow return diverting valve, such that said electronic control system controls the flow of hydraulic fluid under pressure from said fluid reservoir and the return flow of said hydraulic fluid thereto.

16. A fluid flow control system for use with an automotive vehicle lift structure having two adjacent vehicle support members, comprising:

a source of fluid;

at least one fluid actuated lifting component associated with each vehicle support member, each of said lifting components configured to raise or lower said associated support member responsive to a flow of fluid between said lifting component and said source of fluid;

a bi-directional fluid flow divider/combiner circuit configured to regulate said fluid flow between said lifting components and said source of fluid;

a bi-directional fluid flow diverting valve interposed between said source of hydraulic fluid and each of said fluid actuated lifting components associated with said vehicle support members, said fluid flow diverting valve configured to establish a fluid flow connection between said lifting components associated with one of said vehicle support members and said source of hydraulic fluid, bypassing said fluid low divider/combiner circuit; and an electronic control circuit responsive to variations in vertical positioning between each of said vehicle support members to alter fluid flow configurations in said bi-directional fluid flow diverting value during ascending and descending motion of said vehicle support members, wherein additional fluid is supplied to said at least one lifting cylinder associated with a lagging vehicle support member during ascent and wherein additional flow is withdrawn from said at least one lifting cylinder associated with a lagging vehicle support member during descent.

17. The fluid flow control system of claim 16 wherein said bi-directional fluid flow diverting valve is altered by said electronic control circuit such that said additional supplied fluid to said at least one lifting cylinder associated with said lagging vehicle support member during ascent is routed from said source of fluid.

18. The fluid flow control system of claim 16 wherein said bi-directional fluid flow diverting valve is altered by said electronic control circuit such that said additional supplied fluid to said at least one lifting cylinder associated with said lagging vehicle support member during ascent is routed from a fluid flow to at least one lifting cylinder associated with a leading vehicle support member during ascent.

19. The fluid flow control system of claim 16 wherein said bi-directional fluid flow diverting valve is altered by said electronic control circuit such that said additional withdrawn fluid from said least one lifting cylinder associated with said lagging vehicle support member during descent is routed to said source of fluid.

20. A method for regulating fluid flow in an automotive vehicle lift system having two elevating vehicle support members adjacently disposed, at least one fluid actuated lifting component associated with each of said vehicle support members to raise and lower said vehicle support members, a source of fluid, and a configurable fluid circuit providing a fluid connection between each of said fluid actuated lilting components and said source of fluid, comprising the steps of:

sensing variations in vertical elevation between each of said vehicle support members during movement; and altering in response to said sensed variations in vertical elevation exceeding a predetermined limit, said configurable fluid circuit to increase fluid flow to said lifting components associated with a vertically lower vehicle support member during ascending motion, and to increase fluid flow from said lifting components associated with a vertically higher vehicle support member during descending motion;

wherein said increased fluid flow is allowed by use of a fluid flow diverting valve interposed between said source of fluid and each of said at least one fluid actuated lifting components.

* * * * *